US006152673A

United States Patent [19]

Anderson et al.

[11] Patent Number: 6,152,673

[45] Date of Patent: Nov. 28, 2000

[54] APPARATUS AND METHOD OF AUTOMATED FORK REPOSITIONING

[75] Inventors: James M. Anderson, Toccoa, Ga.; Robert M. Clark, Liberty; Gordon D. James, Mountain Rest, both of S.C.

[73] Assignee: Toccoa Metal Technologies, Inc., Toccoa, Ga.

[21] Appl. No.: 08/935,620

[22] Filed: Sep. 23, 1997

Related U.S. Application Data

[63] Continuation-in-part of application No. 08/911,663, Aug. 15, 1997, which is a continuation-in-part of application No. 08/400,328, Mar. 7, 1995, Pat. No. 6,059,511.

[51] Int. Cl.[7] ..... B65F 3/04

[52] U.S. Cl. ..... 414/408; 414/421; 414/810

[58] Field of Search ..... 414/406, 408, 414/420, 421, 699, 810, 815

[56] References Cited

U.S. PATENT DOCUMENTS

| | | | |
|---|---|---|---|
| 3,662,910 | 5/1972 | Herpich et al. | 214/302 |
| 4,057,156 | 11/1977 | Thompson et al. | 414/420 X |
| 4,119,212 | 10/1978 | Flemming | 414/730 X |
| 4,647,267 | 3/1987 | Hund, Jr. | 414/408 |
| 5,004,392 | 4/1991 | Naab | 414/21 |
| 5,006,030 | 4/1991 | Smith et al. | 414/406 |
| 5,015,142 | 5/1991 | Carson | 414/408 |
| 5,019,761 | 5/1991 | Kraft | 414/730 X |
| 5,062,759 | 11/1991 | Pieperhoff | 414/408 |
| 5,064,333 | 11/1991 | Würtz | 414/408 |
| 5,222,853 | 6/1993 | Carson | 414/408 |
| 5,322,407 | 6/1994 | Reck et al. | 414/406 |
| 5,525,022 | 6/1996 | Huntoon | 414/408 X |
| 5,851,100 | 12/1998 | Brandt | 414/421 X |

*Primary Examiner*—James W. Keenan
*Attorney, Agent, or Firm*—Kennedy, Davis & Hodge, LLP

[57] ABSTRACT

A front loading refuse collection vehicle (10) is provided having a body (12) which includes a hopper (16), a storage container (17), a pair of arms (56) coupled to a pivotal fork (58). The vehicle also has a control circuit (100) which coordinates movement of the fork with the arms. The control circuit receives the initial pickup position of the arms and fork from an arm position sensor (200) and a fork position sensor (201) when grasping a portable container. This position is later recalled to assist the operator in returning the arms and forks to these positions in order to release the portable container.

5 Claims, 9 Drawing Sheets

APPARATUS AND METHOD OF AUTOMATED FORK REPOSITIONING

REFERENCE TO RELATED APPLICATION

This is a continuation-in-part of U.S. patent application Ser. No. 08/911,663 filed Aug. 15, 1997, which is a continuation-in-part of U.S. patent application Ser. No. 08/400,328 filed Mar. 7, 1995, now U.S. Pat. No. 6,059,511.

TECHNICAL FIELD

This invention relates to refuse vehicles, and specifically to refuse vehicles having movable forks and arms for lifting and dumping a portable container.

BACKGROUND OF THE INVENTION

Refuse vehicles have existed for many years. These vehicles typically have a cab, a hopper, a portable container lifting system and a storage body or compartment in which the refuse is dumped into and stored during transportation. The lifting system has a pivotal arm having a pivotal fork at the end thereof. The fork has tines which are configured to be received within receiving channels on the sides of a portable container which is stationed at the pick-up location.

In use, an operator drives the vehicle to a pick-up site where the refuse is transferred from the portable container to the vehicle storage compartment. The operator typically aligns the height and orientation of the tines of the fork with the receiving channels of the portable container, then advances the vehicle so that the tines slide into the container receiving channels. The arms are then pivoted backwards and the forks rotated to a position wherein the portable container is nearly inverted above the hopper so that refuse therein is dumped into the vehicle storage compartment. The operator then returns the container to the ground and removes the fork tines from the receiving channels of the portable container.

Should the portable container be placed upon uneven terrain, it is often difficult to align the fork tines with the container receiving channels. Additionally, this same problem occurs when extracting the fork tines upon return of the container to the ground. Should the forks be misaligned upon withdrawal of the tines, they may drag the container across the ground as the vehicle is reversed.

Another problem has come about since many containers are positioned upon loading docks elevated above street level. Here, the operator must raise the arms and then align the fork with a container which may be located six to eight feet above the street. The operator must align the fork with the arms substantially pivoted backwards towards the dumping position. After the contents are dumped from the container, the arms and forks must be returned to this elevated position. The task of initially aligning the forks with the arms in an elevated position and its return to this position has proven to be difficult.

Accordingly, it is seen that a need remains for a refuse vehicle which may easily realign the forks to facilitate their removal from the receiving channels of a portable container. It is to the provision of such, therefore, that the present invention is primarily directed.

SUMMARY OF THE INVENTION

In a preferred form of the invention a refuse collection vehicle comprises a vehicle cab, a vehicle chassis, a body into which refuse may be loaded, and a loader device. The loader device includes an arm which pivots about a first pivot axis located on the chassis from a loading position to an unloading position. The arm includes a lifting mechanism for pivotal motion thereof about the first pivot axis. The loader device also includes a fork adapted to releasably hold a container. The fork extends from the arm and pivots about a second pivot axis located on the arm from a loading position to an unloading position. The fork including a rotating mechanism for rotating the fork about the second pivot axis. A controller coordinates operation of the rotating mechanism from the unloading position back to a corresponding selected loading position. The controller including a first positioning sensor coupled to the arm to sense the pivotal position of the arm relative to the body and to produce a selected actual arm position, an input for receiving and memorizing the selected actual arm position from the first positioning sensor, a second positioning sensor coupled to the fork to sense the pivotal position of the fork relative to the arm and to produce a selected actual fork position, an input for receiving and memorizing the selected actual fork position from the second positioning sensor, and control means for controlling the actuation of the rotating mechanism to the selected actual fork position in response to actuation of the lifting mechanism from the arm unloading position to the fork loading position. With this construction, the first and second positioning sensors relay a selected actual arm and fork position upon initial grasping of the container, and subsequent to unloading the container the forks are automatically returned by the control means to the selected actual fork position with return movement of the arms by the lifting mechanism for release of the container.

DETAILED DESCRIPTION

Figure 1:
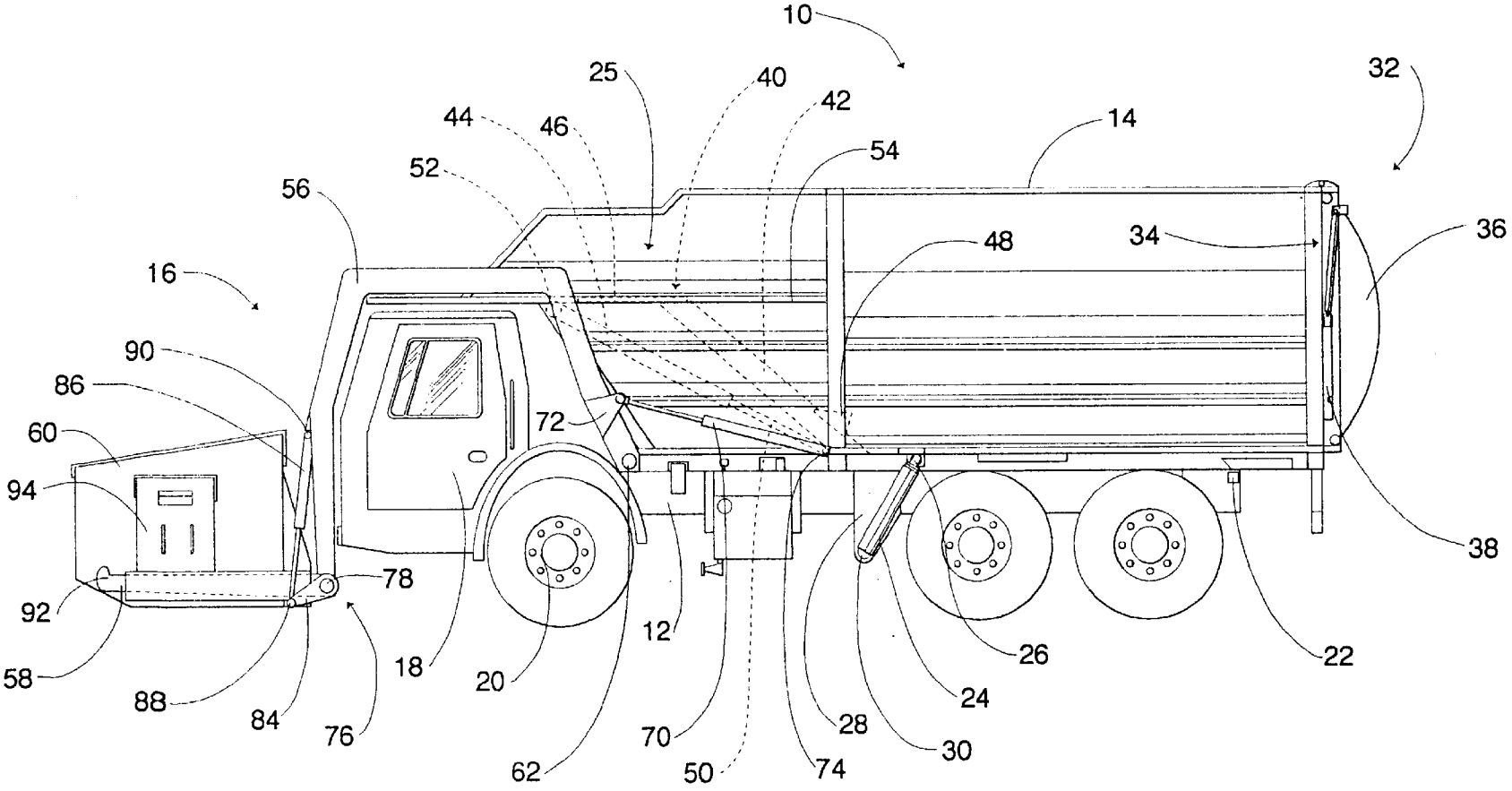
FIG. 1 is a side view of a residential front loading refuse collection vehicle constructed according to the principles of the present invention, showing the loader mechanism of the vehicle in a lowered loading position.

Referring now to the drawings, FIG. 1 shows a side view of a residential front loading refuse collection vehicle 10 constructed according to the principles of the present invention. As used herein, the term "refuse" is meant to include any type of loadable material, including but not limited to recyclable and non-recyclable materials. As shown in FIG. 1, the vehicle 10 comprises a vehicle chassis/cab 12 onto which is mounted a body 14 and a loader device 16.

The vehicle chassis/cab 12 in the preferred embodiment is a Volvo-GM truck chassis/cab model WXLL64, although it is contemplated that other chassis/cabs may be suitable for implementing the present invention. The vehicle cab includes a door 18 positioned in front of a front wheel 20 of the vehicle. The bottom of the door 18 resides below a top of the front wheel 20, so that the driver of the vehicle need not cover too great a distance when exiting and re-entering the cab to attend to the loader mechanism 16. The vehicle chassis/cab 12 is also provided with dual driving controls located on each side of the cab. Dual driving controls are available in Volvo-GM trucks as an option. This option is also available from other cab/chassis manufacturers.

The body 14 is preferably welded together from steel components and is mounted to the truck chassis by a hinge 22 near the rear of the body. The front of the body 14 is connected to the chassis by a pair of cylinders 24 which are used to raise the front of the body to empty the contents of the body after it has been filled through an opening 25. The extendable (rod) ends of cylinders 24 are attached to the body 14 with bolts 26, and the inextendable ends of cylinders 24 are attached to a plate 28 on the chassis by bolts 30. The body when raised by the cylinders 24 pivots about hinge 22 to an unloading position. After being emptied, the body may be lowered back into the position shown in FIGS. 1 and 2.

The body 14 includes a tailgate assembly 32 which covers an exit passage 34 located at the rear of the body. The tailgate assembly 32 includes a tailgate 36, preferably made of steel, and a hydraulic tailgate latching mechanism 38. The hydraulic tailgate latching mechanism 38 may be either of those latching gate mechanisms disclosed in U.S. Pat. No. 4,307,541 to Farmer et al. or U.S. Pat. No. 4,665,649 to Hund, Jr., both of which are assigned to the assignee of the present invention.

Figure 3:
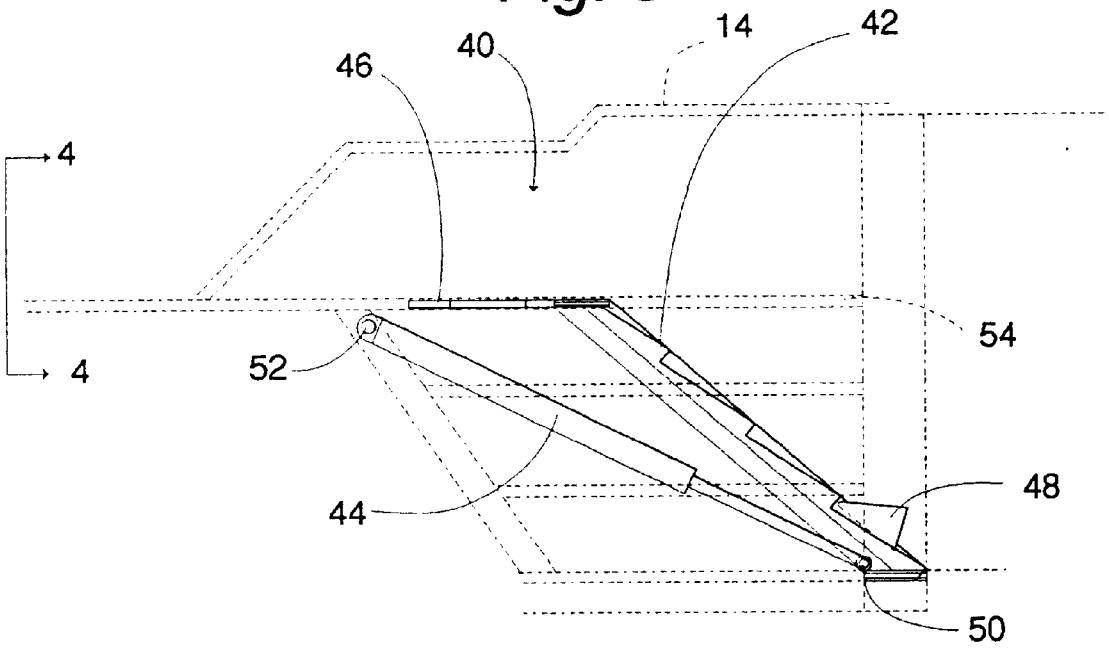
FIG. 3 is a side view of the packer mechanism of the vehicle of FIG. 1 and 2.
Figure 4:
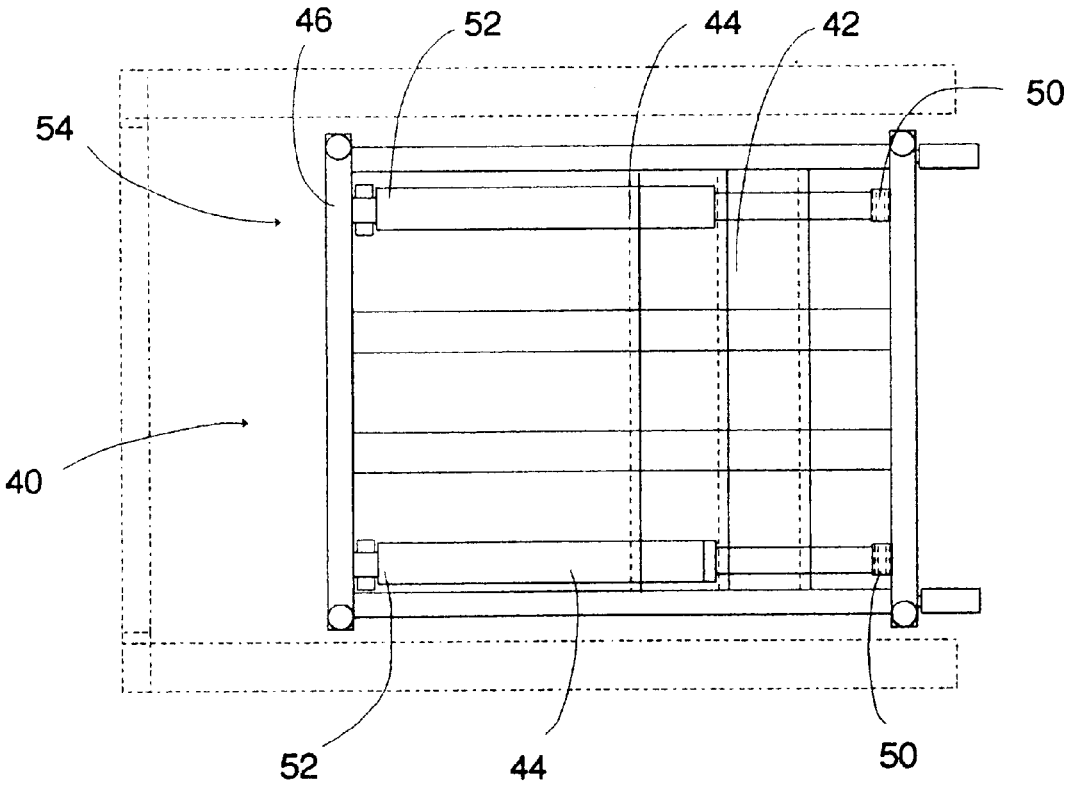
FIG. 4 is a front view of the packer mechanism of FIG. 3, taken along the lines 4—4.

The body also includes a packer mechanism 40 for packing the contents of the body 14. The packer device 40 includes a packer blade 42, a pair of packer cylinders 44, and a packer follower 46 (see also FIGS. 3 and 4). The packer blade 42 is provided with teeth 48, and accomplishes packing of the contents of the body 14 through rearward movement effectuated by the packer cylinders 44. The extendable ends of packer cylinders 44 are mounted to the packer blade 42 by bolts 50, and the inextendable ends of the packer cylinders 44 are mounted to a forward portion of the body 14 by bolts 52.

The packer follower 46 is attached to the top of the packer blade 42 and extends horizontally forward within a channel 54 in the body 14. The packer follower is slidable within the channel 54 and moves along with the packer blade 42. In addition to providing physical support for the top of the packer blade 42, the packer follower prevents material loaded through opening 25 from falling behind the packer blade 42 and interfering with the packer cylinders 44.

Figure 2:
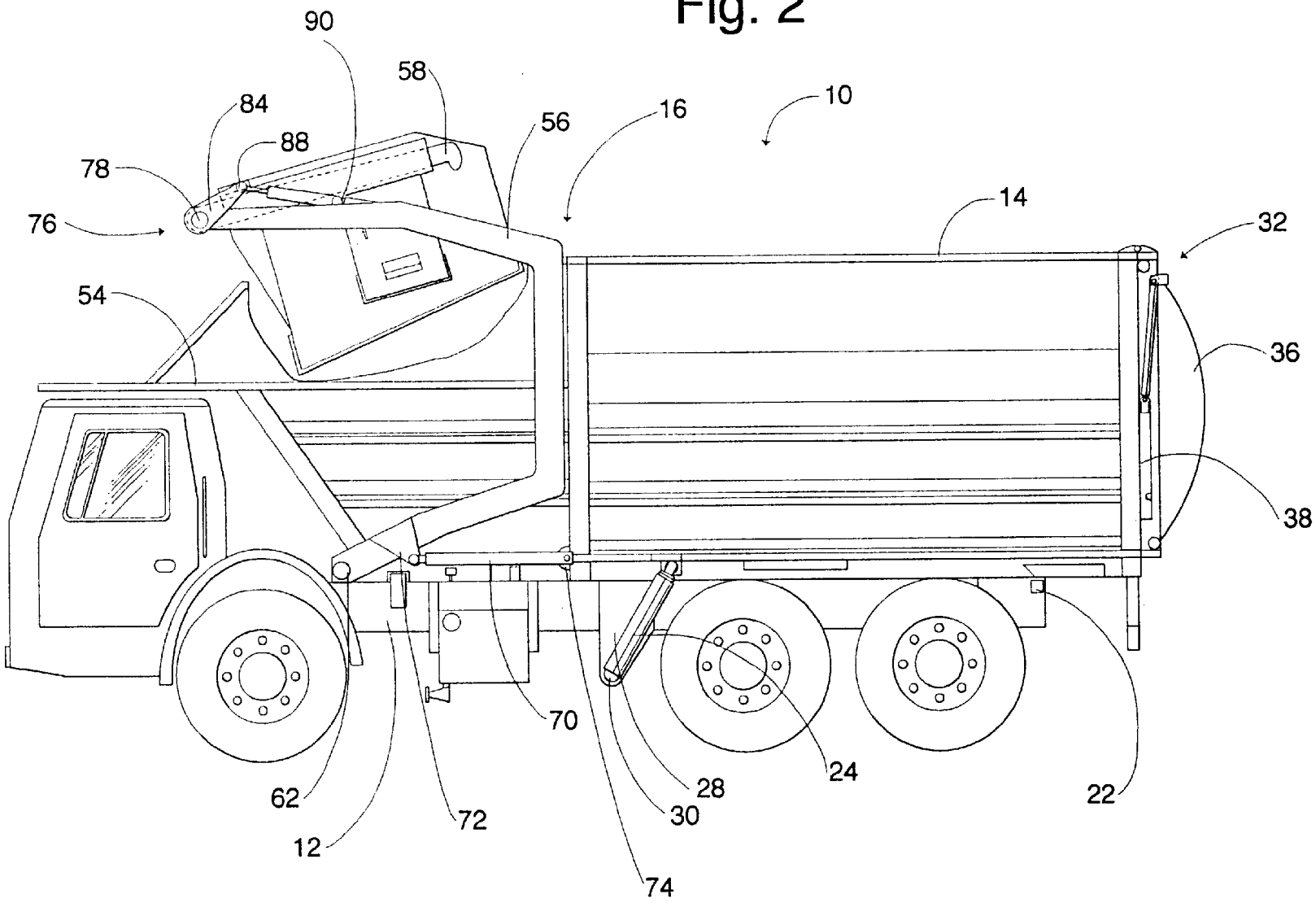
FIG. 2 is a side view of the residential front loading refuse collection vehicle of FIG. 1, showing the loader mechanism of the vehicle in a raised dumping position.
Figure 5:
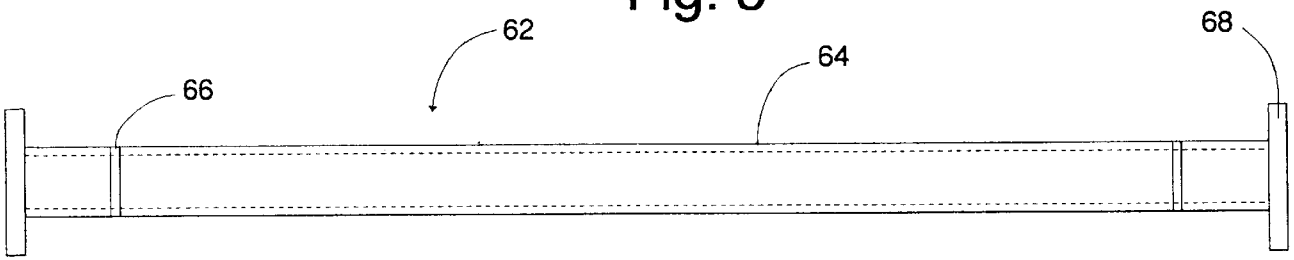
FIG. 5 is a plan view of a rear torque tube assembly for the loader mechanism of the vehicle of FIGS. 1 and 2.

The loader device 16 comprises a pair of arms 56, a rotating fork 58 having prongs 58A and 58B which extend, respectively, from the pair of arms 56, and a container 60 which rests upon the fork prongs. The arms 56 are pivotally mounted at one end to the chassis by a rear torque tube assembly 62 upon which the arms pivot between their lowered and raised positions (FIGS. 1 and 2, respectively). As shown in FIG. 5, the rear torque tube assembly 62 includes a torque tube 64 provided with a spacer 66 and a flange 68 on each end. The tube spans the arms 56 and fits through holes in the ends of the arms so that each arm is positioned between a spacer 66 and a flange 68. A ball bearing (not shown) is fitted within the holes in the ends of the arms and surrounds this portion of the tube. The rear torque tube assembly 62 having the arms installed thereon is bolted to the chassis at the locations of the flanges 68. Because the ball bearing provides a nearly frictionless interface between the arms and the rear torque tube assembly, the rear torque tube provides a fixed first pivot axis about which the loader device 16 pivots when being raised and lowered.

The arms 56 are rotated about the rear torque tube assembly 62 and a pair of cylinders 70, each one of the 15. pair attached to a single raising arm. Each cylinder 70 is pivotally attached (i) at its extendable end to a respective arm at the location of a plate 72 secured to the arm, and (ii) at its inextendable end to the body at the Location of a bracket 74 secured to the body.

As shown in their lowered position in FIG. 1, the arms 56 extend from the rear torque tube assembly 62 up the back of the cab, over the roof of the cab, and down the face of the cab. At these forward ends of the arms, opposite the rear torque tube assembly ends, is where the fork prongs 58A, 58B extend, forwardly. The fork prongs 58A, 58B are fixedly attached to the arms 56 by a front torque tube assembly 76 which extends between the forward ends of the arms.

Figure 7:
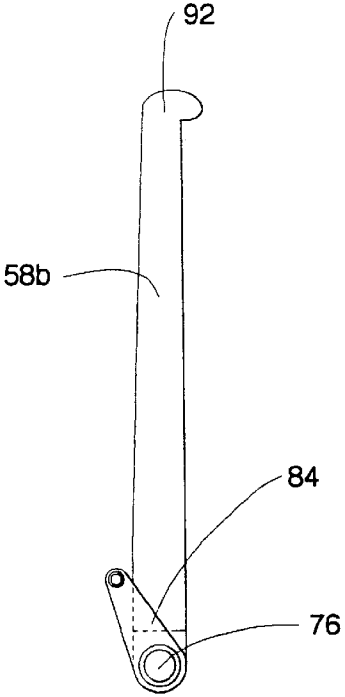
FIG. 7 is a side view of the front torque tube assembly of FIG. 6, taken along the lines 7—7.
Figure 6:
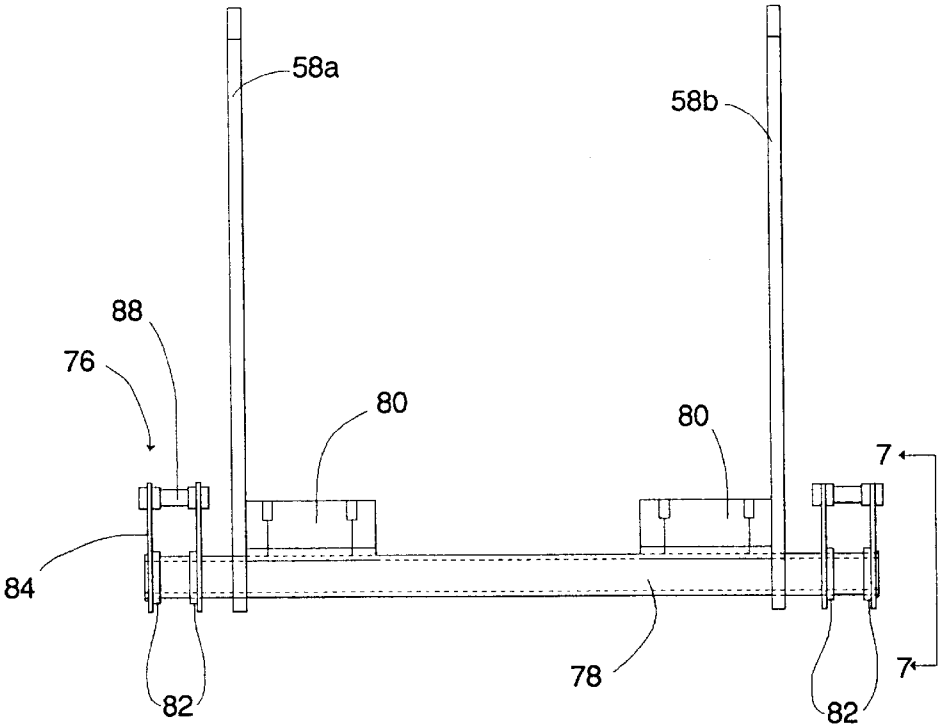
FIG. 6 is a plan view of a front torque tube assembly for the loader mechanism of the vehicle of FIGS. 1 and 2.

FIGS. 6 and 7 show the front torque tube assembly in more detail, as shown assembled with the fork prongs 58A and 58B. The front torque tube assembly 76 includes a torque tube 78 which is fixedly attached to both of the fork prongs 58A and 58B by steel mounting plates 80. The tube 78 fits through holes in the forward ends of the arms so that each arm is positioned between a pair of spacers 82. A ball bearing (not shown) is fitted within the holes in the forward ends of the arms and surrounds this portion of the tube 78. Because the ball bearing provides a nearly frictionless interface between the arms and the front torque tube assembly, the torque tube provides a second pivot axis about which the fork, which is fixedly attached to the tube, rotates with respect to the arms 56.

The fork/front torque tube assembly is rotated by two pairs of levers 84, attached to the tube 78, which are moved by cylinders 86. Hydraulic fluid lines (not shown) for the cylinders 86 run along the outside of the arms 56. The levers are attached to the tube at the location of the spacers 82 (see FIG. 6). The cylinders 86 are attached at their extendable ends to the levers 84 at the location of bolts or posts 88, and at their inextendable ends to mounting brackets 90 on the arms 56. Full extension of the cylinders 86, then, maintains the fork 58 in a loading position in which the prongs extend from the arms at approximately a right angle (see FIG. 1). Full retraction of the cylinders 86 rotates the prongs about the second pivot axis defined by the front torque tube to an unloading position in which the prongs are approximately parallel with the arms (see FIG. 2).

Although in the preferred embodiment of the inventive front loading vehicle described above, cylinders 24, 44, 70, 86, and the tailgate latching mechanism 38 are all hydraulically operated, it is contemplated that other types of mechanisms for extending, lifting, pivoting and rotating may be used in practicing the invention as hereinafter claimed. Also, when hydraulic cylinders are utilized, the vehicle 10 is outfitted with a hydraulic fluid reservoir and the required control valves as is known in the art.

The container 60 in the preferred embodiment rests on the prongs of the fork 58. The position of the container is maintained on the fork by a protruding hump 92, located on the distal ends of each of the fork prongs, which prevents the container from slipping off of the fork. When used in the residential environment, the container remains on the vehicle 10 and is moved from residence to residence.

The vehicle 10, however, may also be easily converted to commercial applications by removing the container 60 from the fork 58. The fork 58, without further modification, is then ready to lift commercial-type containers by mating with fork-receiving channels therein. The arms 58 may be lowered in a manual mode of operation to a position lower than that shown in FIG. 1 so that the vehicle may back away from the commercial type container after it has been set upon the ground.

The container is also provided with an automatic cart loading device 94 attached to the container 60. The automatic cart loading device 94 may be attached to either side of the container or to the front of the container, and is used in residential areas where residents place wheeled carts curbside for pick-up. In the preferred embodiment, an automatic cart loading device such as that provided by Zarn of Reidsville, N.C. 27323 is installed on the container. Other types of automatic cart loading device units which may be installed on the container include those types shown in U.S. Pat. No. 4,673,327 to Knapp and U.S. Pat. No. 4,687,405 to Olney. The automatic cart loading device is installed as a unit and separate hydraulic lines and controls are run to the unit along the arms 56.

Figure 8:
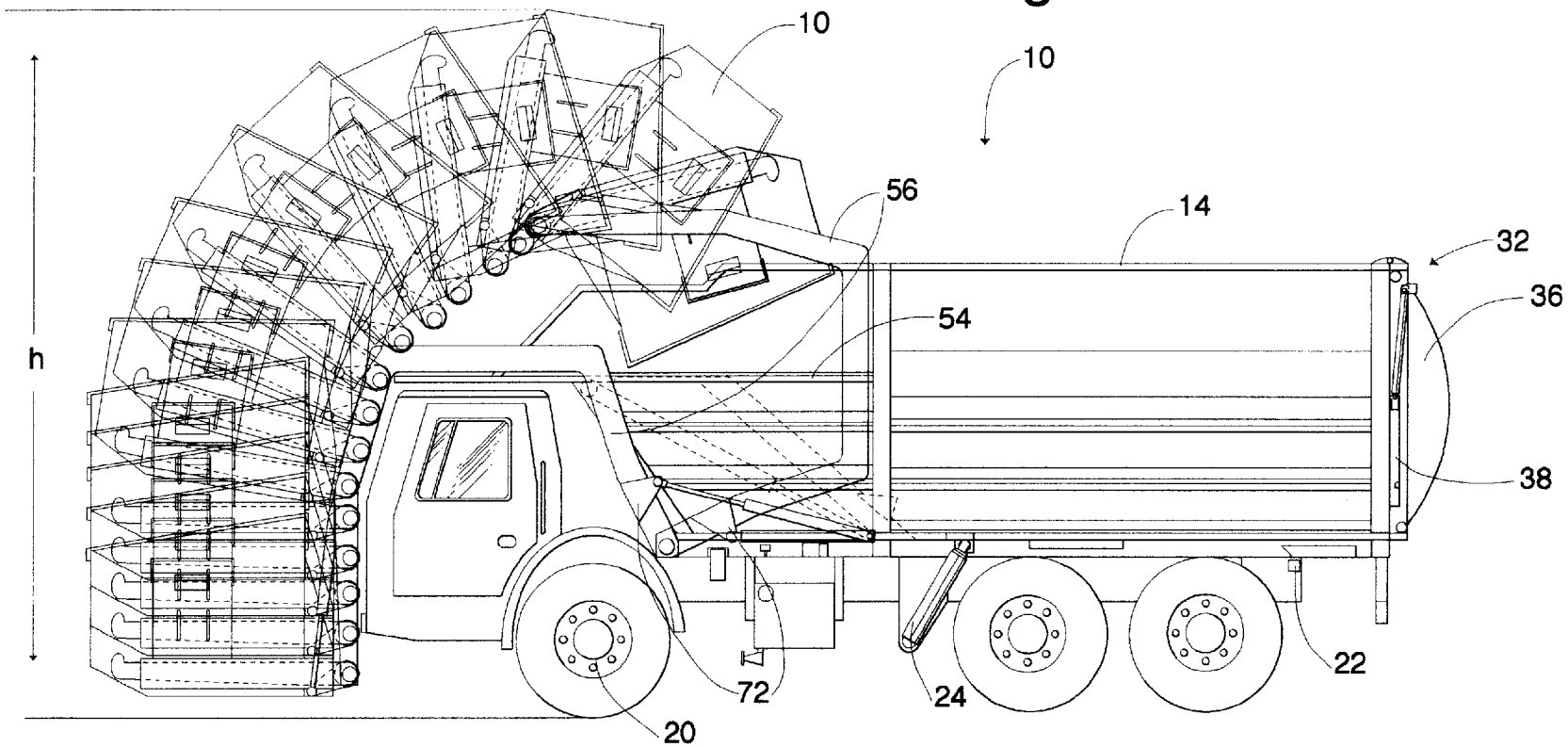
FIG. 8 is a side view of the residential front loading refuse collection vehicle of FIGS. 1 and 2, showing the various positions of the loader mechanism of the vehicle occupied between the lowered loading position of FIG. 1 and the raised dumping position of FIG. 2.

FIG. 8 is a side view of the residential front loading refuse collection vehicle of FIGS. 1 and 2, showing the various positions of the loader mechanism of the vehicle occupied between the lowered loading position of FIG. 1 and the raised dumping position of FIG. 2. As shown in FIG. 8, the container 60 reaches a maximum height h as measured from ground level during this load-unload path.

Because it is contemplated that the inventive front loading refuse collection vehicle 10 is to be used in residential environments, the vehicle loader mechanism 16 includes a control circuit (see FIG. 9) for controlling the operation of the lifting arms 56 and the fork 58 to minimize the maximum height h that the container may attain while being unloaded. The control circuit provides for operation of the loader device in an automatic mode by coordinating simultaneous operation of the arms and the fork. This automatic mode of operation permits precise articulation of the position of the fork, and thus the container positioned thereon, with respect to the arms. In this manner, it is possible to rotate the fork while the arms are being raised to articulate the container so as to minimize the overall height h that the container will achieve as it is being raised.

As further explained below, the control circuit includes (i) an input for receiving an actual arms position signal from the arms lifting mechanism indicating the position of the arms with respect to the body, (ii) a translation circuit for translating a stored arms position matching the actual arms position signal into a desired fork position corresponding to the stored arms position, and (iii) an output for outputting a fork position control signal to the rotating mechanism indicating the desired fork position, to minimize an overall maximum height that the container achieves while being lifted and rotated while insuring that the container is sufficiently rotated to effectuate emptying of its contents into the body.

Figure 9:
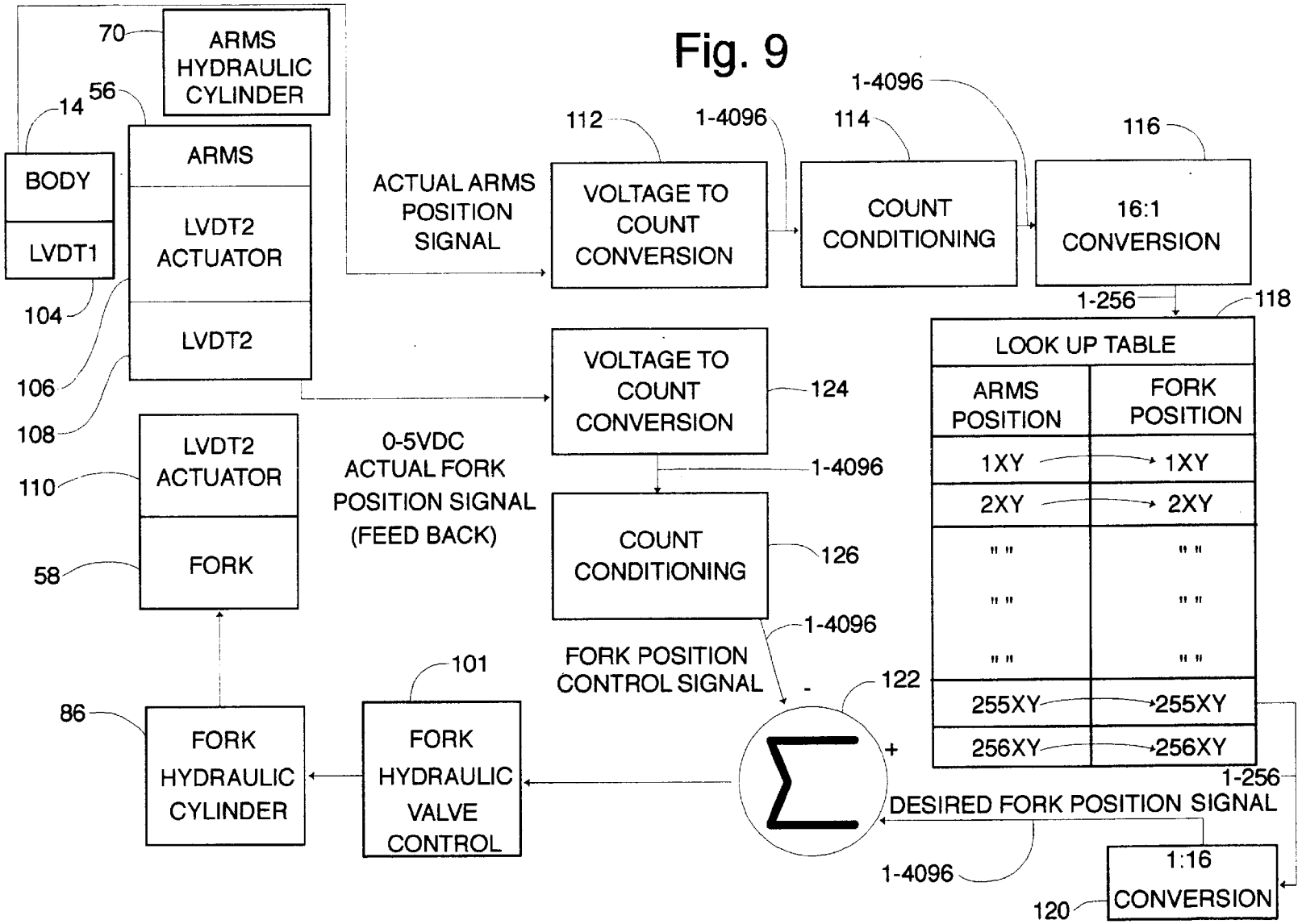
FIG. 9 is a schematic of a control circuit used to control the loader mechanism of the residential front loading refuse collection vehicle of FIGS. 1 to 3.

One embodiment of the control circuit is shown in FIG. 9 as circuit 100. The purpose of control circuit 100 is to position the fork (i.e. control the degree of rotation thereof) with respect to the arms based on the position of the arms with respect to the vehicle body. By predefining a desired position for the fork for each of a corresponding plurality of positions for the arms, and knowing the dimensions of the container positioned on the fork, the path which the container follows from the loading position to the unloading position (see FIG. 8) may be predetermined. Specifically, by predefining the corresponding arms/fork position combinations, the maximum height that the container will achieve during this path can be minimized. This manner of operation is particularly important in residential environments where vertical clearance for a front loader mechanism is limited by tree limbs, electrical wires, and other environmental obstacles. Because the control circuit loo coordinates the position of the fork with respect to the arms, position sensors in the form of linear variable displacement transducers (LVDTS) are utilized to report the respective positions of the fork and the arms. In the preferred embodiment, LVDTs such as model F65106101, manufactured by Data Instruments of Acton, Mass., are used. A first transducer 104 (LVDT1) is mounted to the vehicle body 14 and a corresponding actuator rod 106 is mounted to the arms 56. The output of LVDT1 is the actual arms position signal relative to the body. A second transducer 108 (LVDT2) is mounted to the arms 56 with a corresponding actuator rod 110 mounted to the fork 58. The output of LVDT2 is the actual fork position signal relative to the arms.

The control circuit 100 shown in FIG. 9 is mounted in the vehicle cab and is implemented in a digital hydraulic controller such as model DMC II manufactured by Vickers of Rochester Hills, Mich. The control circuit 100 is implemented as a combination of controller hardware and programmed software which customizes the controller for the intended application. The inputs to the controller are the outputs of LVDT1 and LVDT2 (the actual arms position signal and actual fork position signal, respectively). The output of the controller is a fork position control signal which is fed into a fork hydraulic valve control 101. The output of the fork hydraulic valve control directs the fork hydraulic cylinder 86 to position the fork based on the detected posit-ion of the arms.

The actual arms position signal (output of LVDT1) is a 0–5 volts DC (VDC) signal. The controller includes a voltage-to-count converter 112 which converts the 0–5 VDC signal to a 1–4096 numerical count. This numerical count is conditioned by a count conditioner 114 to account for minor differences in LVDT outputs caused by individual LVDT operational characteristics. The conditioned 1–4096 count is then divided by 16 by divider 116 to arrive at a conditioned 1–256 count.

The conditioned 1–256 count is matched to one of a corresponding 256 arms positions which are entered and stored (i.e. programmed) into a memory device 118 such as a look-up table in the controller. In the preferred embodiment of the present invention, the memory device 118 is an electrically erasable programmable read only memory (EEPROM) device which stores 256 possible positions of the arms beginning at the loading position and ending at the unloading position. The position entries identify the position in terms of x-y (horizontal-vertical) coordinates. For example, the loading position, in which the arms cylinders are fully extended and the arms occupy their lowest vertical and most forward position, may be identified as the origin, or 0—0 position. The other 255 arms positions may be identified as measured in the x and y directions from this origin.

The EEPROM also has stored therein position entries for the fork for each of the 256 arms position entries. Similar to the positioning scheme described above with respect to the arms, the loading position, in which the fork cylinders are fully extended and the forks extend at approximately a right angle from the arms, may be identified as the origin, or 0—0 position. The other 255 fork positions may be identified as measured in the x and y directions from this origin.

When fully programmed with all 256 arms positions and all 256 corresponding fork positions, the EEPROM 118 may be used as a look-up table to translate a stored arms position (matching the actual arms position conditioned count) into a desired fork position count corresponding thereto. The desired fork position count (1–256) is then multiplied by 16 by a multiplier 120 to arrive at a 1–4096 count which is used as a first (positive) input to a summing node 122 in the controller.

A second (negative) input to the summing node is a feedback 1–4096 count which is derived from the output of LVDT2 (actual fork position signal). This 0–5 VDC output is converted by a voltage-to-count converter 124 into the 1–4096 numerical count. This numerical count is also conditioned by a count conditioner 126 to account for minor differences in LVDT outputs. The summing node uses this conditioned count as a feedback signal which is summed with the desired fork position signal at the summing node 122 to alter the fork position control signal output by the summing node. In this way, the combination of the controller with the two LVDTs provides real time closed loop control of the positions of the arms and the fork in the front loading vehicle.

The programmability of the EEPROM permits the front loading vehicle of the present invention to be programmed for different types of operations. For example, the maximum height h that the container 60 will achieve during the load-to-unload path may be altered depending on the environment in which the vehicle is to be used. In addition, the EEPROM may be programmed with different arms/fork position combinations depending on the shape and size of the container carried by the fork.

It is contemplated that the inventive control circuit described above may be used in other types of loading vehicles other than the front loading vehicle described above. For example, the control circuit may be used for controlling the arm and fork mechanisms on a side loading or rear loading vehicle. In addition, although the above described container and vehicle body are both shown as having a single compartment, it is contemplated that the inventive control circuit may be used to control the position of a compartmentalized container which is emptied into a correspondingly compartmentalized vehicle body. For example, the container may be divided front-to-back or side-to-side by one or more internal vertical dividing walls to form two or more container compartments.

In addition, the vehicle body may be segregated into two or more vertically or horizontally oriented compartments, such as by one or more internal vertical or horizontal dividing walls in the body. In such a compartmentalized body, the exit passage 34 would be provided with a tailgate assembly 32 which includes a door for each of the body compartments. (See for example, U.S. Pat. No. 5,288,196 to Horning et al., the text of which is incorporated herein by reference as if fully set forth).

Accordingly, the preferred embodiment of a residential front loading refuse collection vehicle has been described. With the foregoing description in mind, however, it is understood that this description is made only by way of example, that the invention is not limited to the particular embodiments described herein, and that various rearrangements, modifications, and substitutions may be implemented without departing from the true spirit of the invention as hereinafter claimed.

Figure 10:
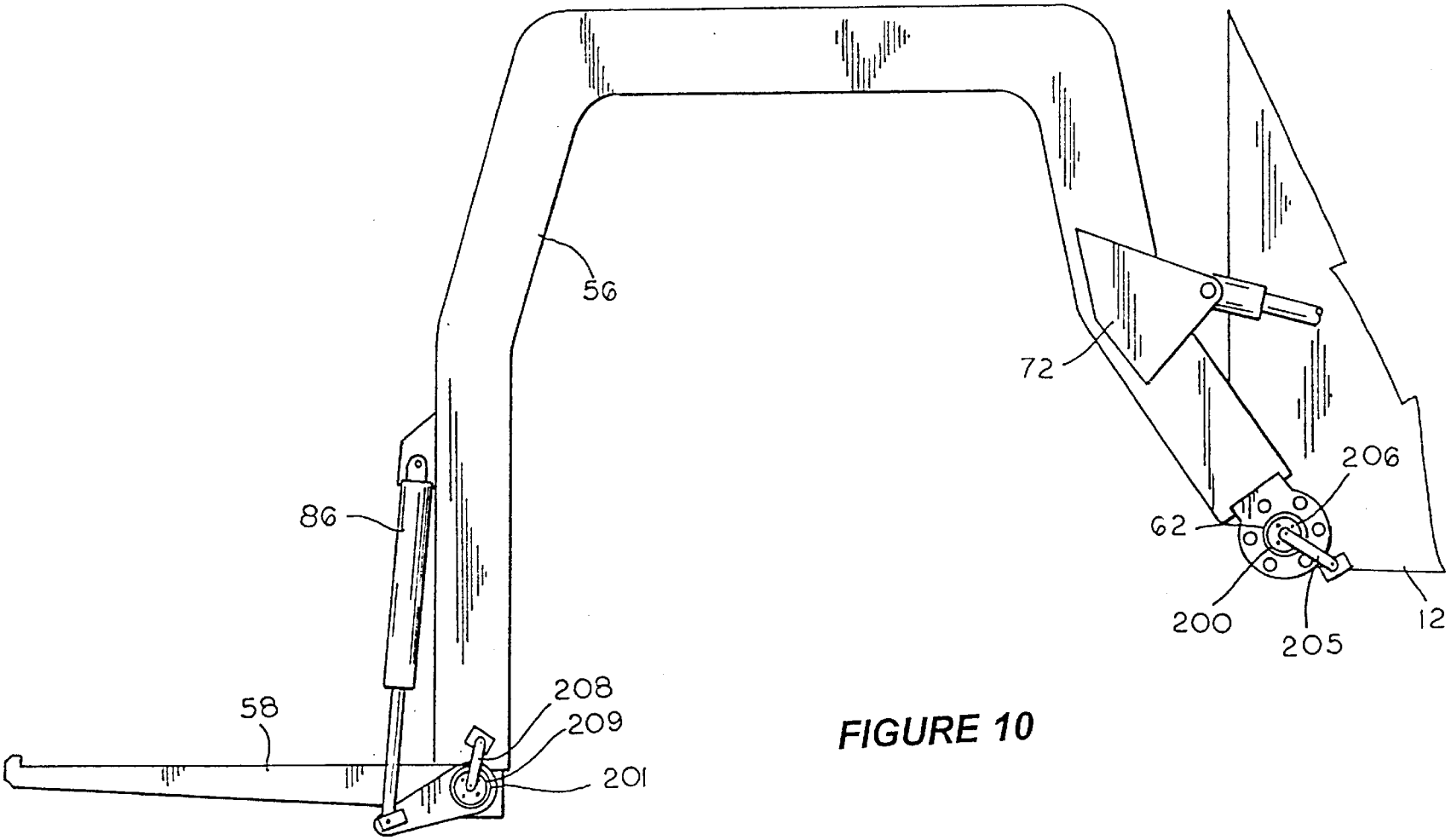
FIG. 10 is a side view of the arms and fork of a refuse collection vehicle in another preferred form of the invention.
Figure 11:
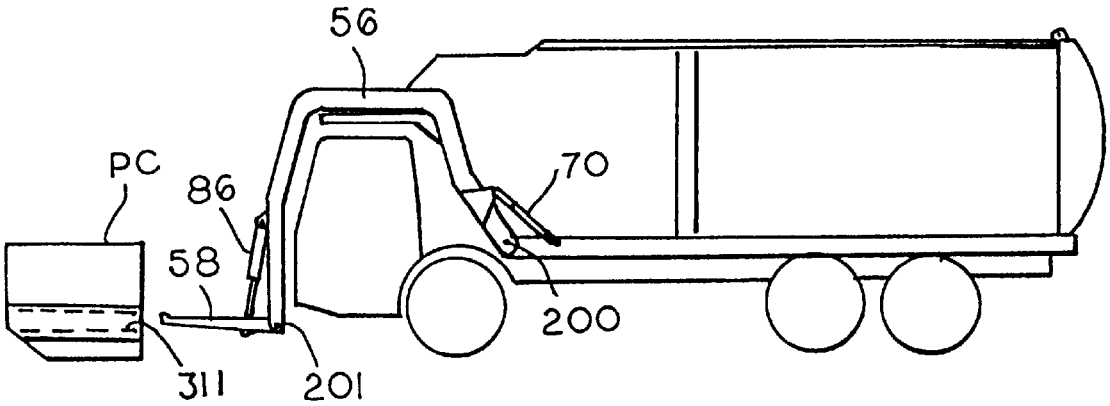
FIGS. 11–14 are a sequence of side views of the refuse vehicle of FIGS. 1–10 which show, in sequence, the fork aligning and container grasping and dumping sequence of the refuse vehicle.
Figure 12:
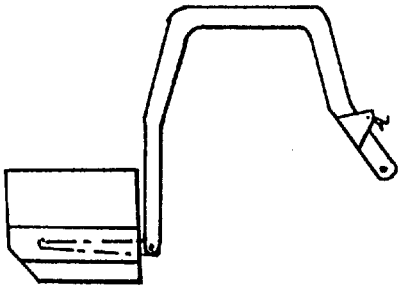
Figure 13:
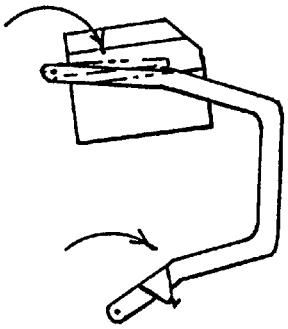
Figure 14:
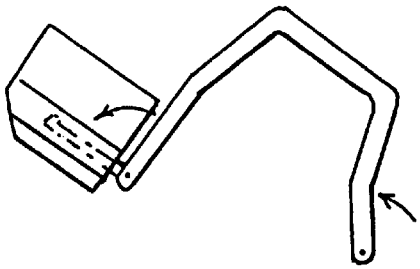
Figure 16:
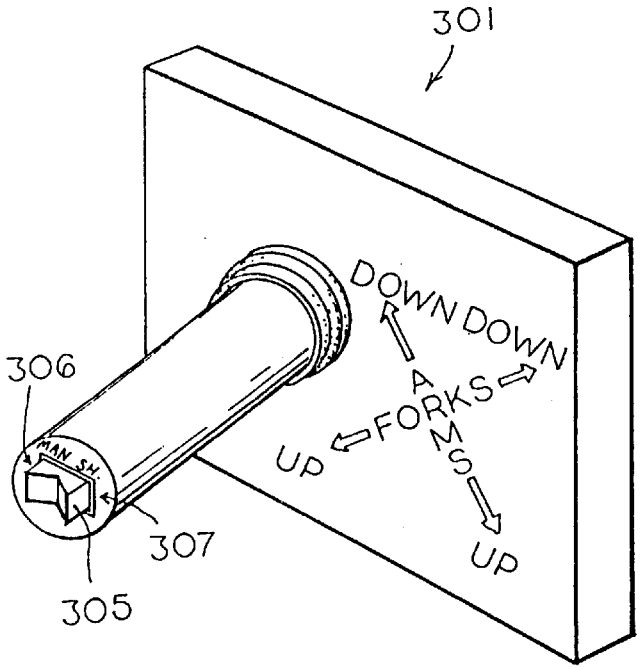
FIG. 16 is a perspective view of a joy-stick controller of the refuse vehicle dumping system of FIG. 15.
Figure 15:
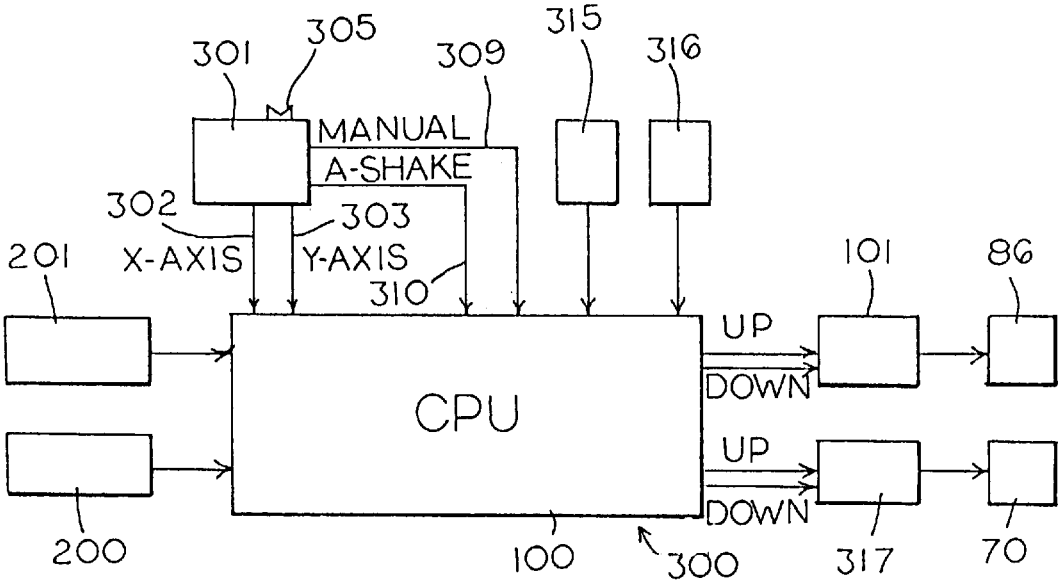
FIG. 15 is a schematic diagram of the refuse vehicle dumping system of the refuse vehicle of FIG. 10.

Referring next to FIG. 10, there is shown a collection vehicle similar to that of FIGS. 1–9 except that the linear variable displacement transducers used in connection with the fork and arms, LVDT1 and LVDT2 respectively, have been replaced with rotary positioning sensors, preferably rotary potentiometers. Here, a first rotary potentiometer 200 is coupled to the arms' rear torque tube assembly 62 along the first pivot axis to monitor the position of the arms relative to the body. A second rotary potentiometer 201 is mounted to the front torque tube assembly 76 along the second pivot axis in coupled engagement with the arms and fork 58 so as to monitor the position of the fork relative to the arms. It should be understood that the function of the rotary potentiometers 200 and 201 is the same as that previously described in reference to the LVDT1 and LVDT2.

The first rotary potentiometer 200 has a rotary arm 205 fixedly mounted to the body so that as arm 56 is pivoted its position relative to the body is detected by the positioning of the potentiometer main body 206 relative to the potentiometer arm 205. Similarly, the second rotary potentiometer 201 has a rotary arm 208 fixedly mounted to arm 56 so that as fork 58 is pivoted its position relative to arm 56 is detected and relayed by the position of the potentiometer main body 209 relative to the potentiometer arm 208.

It has been discovered that the use of rotary potentiometers provide for a smoother operation of the arms and forks as they are moved between their initial positions and their dumping positions. The reasoning for this improvement in operation is that the rate of change between any two consecutive arms and fork positions is constant or linear, i.e. the rate of change between any two positions along the arcuate path of travel is the same as any other two consecutive positions along the arcuate path of travel. This is not true with linear variable displacement transducers wherein the rate of change between consecutive positions changes along the arcuate path of travel. For instance, the rate of change between consecutive positions along the middle portion of the path of travel is faster than the rate of change between two consecutive positions along the beginning or end of the arcuate path. Hence, the rate of change with rotary potentiometers is much more predictable for use in the look-up table as compared with linear variable displacement transducers which must calculate arcuate positions using linear measurements from the LVDTs. The increased predictability greatly decreases the error range in the look-up table, consequently enabling a smoother operation of the forks for each respective arm position in a series.

Referring next in more particularity to FIGS. 11–16, a fork and arm controller 300 is shown for automated return of the fork 58 from a dumping position. The fork and arm controller 300 employs a conventional joy-stick type control 301 coupled to the control circuit 100, shown generally as a CPU in FIG. 15, through an X-axis conductor 302 and a Y-axis conductor 303. The controller of this embodiment includes a flash-memory, such as that made by Orvitek, Inc. of Markham, Ontario, Canada. The flash-memory is configured to store a selected actual arms position signal from the first rotary potentiometer 200 and a selected actual fork position signal from the second rotary potentiometer 201. The joy-stick control 301 has a three position rocker switch 305 having a manual mode position 306, an auto-shake position 307 and a spring biased, central off position. The rocker switch is coupled to the control circuit by a manual mode conductor 309 and auto-shake conductor 310.

In use, an operator drives the vehicle to a position adjacent the portable container PC. With the rocker switch 305 manually forced to its manual mode position 306, the operator manipulates the joy-stick controller 301 so as to position the arms 56 and fork 58 in alignment with the container fork receiving channels 311.

The vehicle is then advanced so that the fork prongs or tines 58A and 58B are received within the receiving channels 311. The operator may have to refine the pivotal position of the arms and forks as the vehicle advances to insure that the fork prongs are properly aligned within the receiving channels.

Once the fork prongs are inserted within the receiving channels 311, the rocker switch 305 is released to spring biasly return to its off position. The release of the rocker switch signals this initial actual arms position and the initial actual fork position, sensed by rotary potentiometers 200 and 201 respectively, to the control circuit 100 for storage in the flash-memory. The operator then manipulates the joy-stick controller 301 so that the control circuit 100 coordinates movement of the fork and arms, through the previously described automated mode, to their dumping position above the hopper. The operator may then force the rocker switch 305 to its auto-shake position 307 to signal the control circuit 100 to actuate the fork rotating mechanism (cylinders 86) to cause the forks 58 to cycle back and forth approximately 10 degrees. This cycling of the fork rotating mechanism causes the portable container to shake so as to ensure all the refuse is removed therefrom.

Once the refuse has been dumped, the operator then manipulates the joy-stick controller 301 to its arm lowering position causing the arms hydraulic cylinder 70 to extend and thereby rotate the arms downward. It should be understood that the actuation speed of the arms is controlled by the distance the joy-stick controller is forced from center. Simultaneously, the control circuit 100 actuates the fork hydraulic valve control 101 to coordinate movement of the fork hydraulic cylinders 86 as previously described. As the arms 56 approach their initial actual arms position, stored in flash-memory, the control circuit 100 overrides the look-up table 118 coordinated positioning of the forks and instead commences to move the forks to their initial actual fork position. Preferably, this is commenced with approximately 2.5 degrees from the initial actual arms position. The control circuit also will not allow the forks to move past their initial actual forks position relative to the arms during downward rotation of the arms, as this would force the control circuit to reverse the direction of the forks to achieve the initial actual fork position. Once the arms and forks are back to their initial positions, the fork tines may be extracted from the container recess by reversing the vehicle.

Thus, it is seen that the control circuit 100 receives an initial position of the arms and fork from the first rotary potentiometer 200 and second rotary potentiometer 201, respectively, associated with the initial pick-up of the portable container. The arms and fork are then returned to this exact position subsequent to dumping with the assistance of the control circuit. Since the arms and forks are returned to their initial position, they may be extracted from the channels of the portable container without further manipulation by the operator, as this was the position of the arms and fork during initial insertion of the prongs. Thus, the necessity of manually operating the arms and forks to a potentially difficult position is eliminated.

Optionally, the system may be modified to include an automatic arm mode of operation. Here, the system also includes an auto-up button 315, an auto-down button 316 and an arm hydraulic valve control 317 coupled to the control circuit. The arm hydraulic valve control 317 controls the actuation of the arm hydraulic cylinders 70.

In use, the operator initially aligns the arms and forks and inputs this position to the control circuit as previously described. Once this has been accomplished, the operator depresses the auto-up button 315 which signals the control circuit to control the pivotal actuation of both the arm and the forks to their dumping position. Once the refuse has been dumped from the portable container, the operator may then depress the auto-down button 316 to signal the controller to automatically control the downward rotation of the arms and fork back to their initial positions. It should be understood that essentially the only difference here is that the control circuit also controls the actuation of the arms, rather than the operator doing so through the joy-stick controller. As a safety precaution, the system will actuate the arms and fork for only so long as the auto-up button or auto-down button is manually depressed. The release of these buttons will cause the control circuit to halt all movement of the arms and fork.

It thus is seen that a refuse vehicle is now provided which may assist in the return of the arms and fork to an initial position so as to allow the efficient removal of the fork prongs from a portable container receiving channels. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A refuse collection vehicle comprising:

a vehicle cab and a vehicle chassis;

a body mounted to said vehicle chassis into which refuse may be loaded; and a loader device for loading refuse into said body, said loader device comprising (i) an arm which pivots about a first pivot axis located on said chassis from a loading position to an unloading position, said arm including a lifting mechanism for lifting motion thereof about said first pivot axis, (ii) a fork adapted to releasably hold a container, said fork extends from said arm and pivots about a second pivot axis located on said arm from a loading position to an unloading position, said fork including a rotating mechanism for rotating motion thereof about said second pivot axis, and (iii) a controller for coordinating operation of said rotating mechanism and said lifting mechanism from said unloading position back to a corresponding selected loading position, said controller including a first positioning sensor coupled to said arm to sense the pivotal position of said arm relative to said body and to produce a selected actual arm position, an input for receiving and memorizing said selected actual arm position from said first positioning sensor, a second positioning sensor coupled to said fork to sense the pivotal position of said fork relative to said arm and to produce a selected actual fork position, an input for receiving and memorizing said selected actual fork position from said second positioning sensor, and control means for controlling the actuation of said rotating mechanism in moving said fork to said selected actual fork position in response to actuation of said lifting mechanism in moving said arm from said arm unloading position to said arm loading position, whereby the first and second positioning sensors relay a selected actual arm and fork position upon initial grasping of the container, and subsequent to unloading the container the fork is automatically returned by the control means to the selected actual fork position with return movement of the arm by the lifting mechanism to said arm loading position.

2. The refuse collection vehicle of claim 1 wherein said controller further comprises second control means for controlling the actuation of said lifting mechanism in moving said arm from said arm unloading position to said selected arm position, and a control switch which enables said second control means.

3. A refuse vehicle comprising:

a container body;

lifting arms;

hydraulic arms lifting means for moving said lifting arms between a loading position and an unloading position above said container body;

a fork pivotally mounted to said arms;

hydraulic fork rotating means for rotating said fork relative to said arms; and control means for controlling said hydraulic fork rotating means, said control means including arm sensing means for sensing and relaying an initial pivotal position of said arms relative to said body, fork sensing means for sensing and relaying an initial pivotal position of said fork relative to said arms, memory means for receiving and storing the initial arms pivotal position from said arm sensing means and storing the initial fork pivotal position from said fork sensing means, and actuation means for actuating said hydraulic fork rotating means to move said fork to said initial fork pivotal position in response to return movement of said lifting arms from said unloading position to said loading position.

4. The refuse vehicle of claim 3 wherein said actuation means controls the actuation of said hydraulic arms rotating means to more said arms to said initial arms pivotal position.

5. A method of automatically positioning the forks of a refuse vehicle of the type having a container body, a pair of arms mounted for pivotal movement between a loading position and an unloading position, hydraulic arm lifting means for moving the arms between the loading position and the unloading position, a fork mounted to the arms for pivotal movement between a loading position and an unloading position, and hydraulic fork rotating means for pivotal movement of the fork between the loading position and the unloading position, the method comprising the steps of:

(a) manually controlling the hydraulic arm lifting means to position the arms at an initial loading position and manually controlling the hydraulic fork rotating means to position the fork at an initial loading position;

(b) sensing the initial position of the arms with an arm sensor and sensing the initial position of the fork with a fork sensor;

(c) relaying the sensed initial position of the arms and the sensed initial position of the fork to control means;

(d) storing the sensed initial position of the arms and fork; and (e) actuating the hydraulic fork rotating means through automatic control means to more said fork to the stored fork position in response to the hydraulic arm lifting means returning the arm to its initial unloading position.

* * * * *